US010752469B2

(12) United States Patent
Novacek et al.

(10) Patent No.: US 10,752,469 B2
(45) Date of Patent: Aug. 25, 2020

(54) FLOOR COVER OF A PASSENGER TRANSPORTATION DEVICE

(71) Applicant: INVENTIO AG, Hergiswil (CH)

(72) Inventors: Thomas Novacek, Schwechat (AT); Manfred Gartner, Felixdorf (AT)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 16/063,045

(22) PCT Filed: Dec. 6, 2016

(86) PCT No.: PCT/EP2016/079940

§ 371 (c)(1),
(2) Date: Jun. 15, 2018

(87) PCT Pub. No.: WO2017/102460

PCT Pub. Date: Jun. 22, 2017

(65) Prior Publication Data

US 2018/0362303 A1 Dec. 20, 2018

(30) Foreign Application Priority Data

Dec. 17, 2015 (EP) ..... 15200950

(51) Int. Cl.
*B66B 23/00* (2006.01)

(52) U.S. Cl.
CPC ..... *B66B 23/00* (2013.01)

(58) Field of Classification Search
CPC ..... B66B 21/00; B66B 21/02; B66B 21/025; B66B 21/04; B66B 21/06; B66B 21/08;
(Continued)

(56) References Cited

U.S. PATENT DOCUMENTS 3,137,382 A * 6/1964 Conover ..... B66B 29/06 198/325
3,144,117 A * 8/1964 Fabula ..... B66B 29/06 198/325

(Continued)

FOREIGN PATENT DOCUMENTS

CN 103449290 A 12/2013
CN 203497907 U 3/2014

(Continued)

OTHER PUBLICATIONS

International Search Report for International Application No. PCT/EP2016/079940 dated Feb. 2, 2017.

*Primary Examiner* — Joseph A Dillon, Jr.
(74) *Attorney, Agent, or Firm* — Knobbe Martens Olson & Bear LLP

(57) ABSTRACT

A floor cover of an escalator or a moving walkway is described. The floor cover has a floor cover support and at least one cover element. The opening of a space provided under the floor to the surrounding floor which can be walked on can be closed in a flush manner by at least one cover element which lies on the floor cover support. The floor cover includes at least one device by which one single possible correct installation position of the at least one cover element on the floor cover support is specified. In the correct installation position, the cover element lies flush on the floor cover support, and in an incorrect installation position, the device causes at least one part of the cover element is arranged so as to visibly project beyond the floor cover support.

18 Claims, 5 Drawing Sheets

(58) Field of Classification Search
CPC ..... B66B 21/10; B66B 21/12; B66B 23/00; B66B 23/08; B66B 23/10; B66B 23/12
USPC ..... 198/324, 325, 326, 333
See application file for complete search history.

(56) References Cited

U.S. PATENT DOCUMENTS 3,687,257 A * 8/1972 Johnson ..... B66B 29/06 198/325
5,029,690 A * 7/1991 Nguyen ..... B66B 23/22 198/335
5,553,697 A * 9/1996 McClement ..... B66B 23/145 198/332
5,597,063 A * 1/1997 Bogle ..... B65G 47/66 198/635
6,138,819 A * 10/2000 Bogle ..... B65G 47/66 198/325
6,142,286 A * 11/2000 Ulrich ..... B66B 29/06 198/325
6,454,078 B1 * 9/2002 Behle ..... B66B 29/06 198/325
7,992,703 B2 * 8/2011 Underberg ..... B65G 15/42 198/324
8,567,591 B2 * 10/2013 Gonzalez Alemany ..... B66B 23/00 198/600
10,364,129 B2 * 7/2019 Landsbeck ..... B66B 21/04
2007/0036626 A1 * 2/2007 Aulanko ..... B66B 23/12 410/46
2007/0137979 A1 * 6/2007 Sheehan ..... B66B 29/06 198/325
2008/0156615 A1 * 7/2008 Aulanko ..... B66B 23/00 198/321
2012/0085618 A1 * 4/2012 Duerrer ..... B66B 23/12 198/330
2016/0304322 A1 * 10/2016 Krampl ..... B66B 23/00
2018/0141784 A1 * 5/2018 Jussila ..... B66B 23/00
2019/0367332 A1 * 12/2019 Liu ..... B66B 23/00

FOREIGN PATENT DOCUMENTS

DE 10014158 A1 10/2001
EP 0661229 A1 7/1995
EP 0885832 A1 12/1998
EP 2177469 A1 4/2010
JP 2012126542 A 7/2012
WO WO200170615 A1 9/2001

* cited by examiner

FLOOR COVER OF A PASSENGER TRANSPORTATION DEVICE

TECHNICAL FIELD

The present application relates to a planar floor cover for covering an entry region of a passenger transportation device, a passenger transportation device equipped therewith, and a method for retrofitting a passenger transportation device.

SUMMARY

Passenger transportation devices, such as escalators or moving walkways, are generally used to transport standing people or objects along an obliquely inclined or horizontal floor on a step belt provided with steps and on a pallet belt provided with pallets, respectively. In this case, the steps or pallets are moved along the oblique or horizontal track by means of a transportation device, such that a person can, for example, step onto the passenger transportation device in a first entry region and step onto one of the steps or one of the pallets in order to then be transported, together therewith, to a second entry region, located at the opposite end of the passenger transportation device, where the person can leave the passenger transportation device again.

In the entry regions at opposite ends of the step belt or of the pallet belt, a planar floor cover is generally used, as a floor which can be walked on, to cover the top of an opening of a space provided under the floor, for example, with technical devices of the passenger transportation device, such that people can reach the moving steps or pallets via the entry region. For example, a deflection shaft comprising deflection sprockets can be arranged in the space provided under the floor, and a drive, the control means thereof and a drivetrain comprising a drive shaft and drive sprockets can also be accommodated in said space.

In this case, in the entry region of the passenger transportation device, the floor cover can ensure a transition, for example, between a floor of the surrounding construction and the step or pallet band moving in the passenger transportation device, which transition can be walked on and is as flush as possible. At the same time, the floor cover can often be designed so as to be removable or openable in order for it to be possible to enter the space located therebelow and comprising the components of the passenger transportation device received therein, for example, in order to be able to repair or service said components.

EP 0 661 229 B1 discloses an angular frame that is connected to the structural parts of a passenger transportation device and functions as a floor cover support for a cover element. The vertical and horizontal position of the angular frame can be adjusted by means of screws and nuts in order to ensure a flush and continuous transition to the surrounding floor. In order to damp footstep noises when the top of the floor is walked on, the bearing surface of the angular frame is covered with a resilient profile, the bottom of said resilient profile being positively connected to the horizontal limb of the angle section of the angular frame.

Since, as mentioned above, the deflection region of the step belt of the escalator or the pallet belt of the moving walkway is generally located in the space provided under the floor, beneath the floor cover, the cover element has to be securely arranged on the floor cover support so that the cover element does not, under any circumstances, slip, lift up, or tilt on the floor cover support and unintentionally release an opening to the space comprising the technical devices, irrespective of the direction of action and the point of application of an external force acting on said cover element.

The object of the present disclosure is that of providing a floor cover which complies with the above requirements and makes incorrect assembly largely impossible or unlikely.

This problem can be solved by a floor cover of an entry region of a passenger transportation device that is designed as an escalator or a moving walkway. The floor cover comprises a floor cover support and at least one cover element. The opening of a space of the passenger transportation device provided under the floor or on the pit side can be closed in a flush manner to the surrounding floor which can be walked on, by means of at least one cover element which lies on the floor cover support. The floor cover includes at least one device that is arranged at least in part between the floor cover support and the at least one cover element. Said device specifies one single possible correct installation position of the at least one cover element on the floor cover support. When correctly assembled, the device ensures that the cover element is arranged so as to lie flush on the floor cover support. When incorrectly assembled, at least one part of the cover element is arranged so as to visibly project beyond the floor cover support or so as to be elevated, on account of the device.

The visible projection of at least one part of the cover element makes it possible to immediately identify that the cover element has not been installed correctly. The device thus signals a dangerous state, even to laymen, and demands that the defect be checked and remedied. The device may be designed in various ways, in order to bring about visible projection of the cover element in the event of incorrect assembly. Depending on the embodiment of the device, said device or parts thereof is/are arranged between the floor cover support of the floor cover and the at least one cover element.

In one embodiment of the disclosure, the device may comprise at least one resilient element and a fastening means or fastener. The at least one cover element is held in the visibly projecting position by the resilient element until the cover element is correctly connected to the floor cover support by the fastening means.

The resilient element may be a block of resilient material or a spring element that is arranged on the floor cover support, for example. If a cover element is then laid on the floor cover support, the spring element holds at least one part of the cover element on the floor cover support in a visibly projecting position. In order to bring the cover element into the correct installation position, said element has to be pressed onto the floor cover support, against the spring force of the resilient element, and fixed in said position by the fastening means. The fastening means may be a screw connection or a locking means, for example. The advantage of a screw connection is that this can be used to compress the resilient element. The proposed first embodiment monitors the fastening means in a simple manner. As soon as the screw connection or the locking means is released, the resilient element moves the cover element back into the incorrect installation position, which can be easily perceived visually.

Moreover, the device, and in particular the locking means, may be in a wide range of forms. It may be a rotary bolt or a sliding bolt, for example. The locking means may also be combined with a lock, for example, with a cylinder lock. The resilient element also does not necessarily need to be arranged so as to be separate from the fastening means. For example, a spring-bolt comprising a snap-in nose may be used, the bolt thereof being held by the resilient element so as to protrude, and the cover element thus being arranged in a projecting manner, in the incorrect installation position, until said element assumes the correct installation position by means of actuating and snapping in the spring-bolt.

In another embodiment of the disclosure, the device may comprise at least one projection on the cover element and a recess on the floor cover support that corresponds to said projection. Of course, the at least one recess may also be formed on the cover element, and a recess corresponding to said projection may be formed on the floor cover support. In the correct installation position, the projection protrudes into the recess, and in the incorrect installation position the at least one cover element is either arranged so as to visibly project by means of the projection protruding, or is arranged so as to project beyond and protrude from the floor cover.

For this purpose, the projection and the recess extend in a plane in parallel with the planar extension of the cover element or in parallel with the floor cover support, such that any tilting moments of the cover element arranged on the floor cover support can be absorbed by the device alone on account of the engagement of the projection in the recess. In order to bring the cover element into the correct installation position, it is not sufficient to simply lay said element on the floor cover support. When laid on the floor cover support, the cover element still has to be shifted in the direction of the extension of the projection until it has reached the correct installation position. If said cover element is only laid on but not shifted, it does not fit into the floor cover support and one side of said element projects therefrom. In some circumstances, the cover element is formed in multiple parts or comprise at least one articulation point in order that the projection can be inserted into the recess.

Preferably, the projection is a strip and the recess is a groove. The strip can be created for example in that an angle section is arranged on a lateral portion of the floor cover support. A groove that corresponds to the strip should then be formed on the cover element as the recess.

In another embodiment of the disclosure, the device may comprise at least one stop piece on the cover element and a notch on the floor cover support that corresponds to said stop piece. Of course, the device may also comprise at least one stop piece on the floor cover support and a notch on the cover element that corresponds to said stop piece. If a plurality of cover elements are provided, the notch may also be formed on a cover element that can be installed following the cover element. It is the case in both embodiments that, in the correct installation position, the stop piece protrudes into the notch and, in the incorrect installation position, the at least one cover element is arranged so as to visibly project due to protrusion of the stop piece. The notch may be formed as a hole, slot, blind hole, groove, pocket, rebound, or the like. The stop piece secures the correct position of the cover element on the floor cover support and results in correct alignment between support regions formed in the edge region of the cover element and the bearing points corresponding thereto that are formed on the floor cover. In the correct installation position, the stop piece protrudes into the recess and, in the incorrect installation position, the at least one cover element is arranged so as to visibly project due to protrusion of the stop piece.

Furthermore, in a development of the embodiment described above, the device may comprise at least one resilient element that is arranged in the region of an end face of the cover element remote from the stop piece or the notch. During assembly, said resilient element has to be compressed by pushing the cover element onto the floor cover support, in order that the cover element can be brought into the correct installation position between the resilient element and the stop piece. If the cover element is simply laid on the floor cover support, the stop piece is necessarily arranged so as to be offset from the notch on account of the expanded resilient element, with the result that at least a part of the cover element protrudes on the stop piece and is thus arranged so as to visibly project beyond the floor cover support.

Moreover, a nose may also be arranged on the stop piece, which nose extends in parallel with the planar extension of the floor cover support. A cap groove corresponding the nose can then be provided on the cover element, the nose being arranged so as to engage in the cap groove in the correct installation position of the cover element. This modification of the stop piece makes it possible for tilting moments of the cover element arranged on the floor cover support to be absorbed by the device alone.

The device preferably comprises, in addition, at least one sensor or switch, by means of which it is possible to monitor the correct or incorrect installation position of the cover element. In the simplest case, this can be implemented using a simple pressure switch or pushbutton which for example immediately interrupts the supply of power to a drive motor of the passenger transportation device as soon as the cover element is in an incorrect installation position or is missing. Of course, the cover element may also be monitored using a sensor that transmits corresponding signals to a control means of the passenger transportation device. Said control means can then trigger suitable measures, for example, immediate braking (emergency stop) of the step belt or pallet belt.

Since the floor cover of a moving walkway or of an escalator usually extends over a very large surface area, a cover element that spans the entire surface area is very heavy. In order to make handling easier for the assembly and servicing personnel, the floor cover may also comprise a plurality of cover elements that are arranged so as to lie on the floor cover support and so as to be adjacent to one another. According to the disclosure, at least one device is provided that forcibly brings about the single possible correct installation position of at least one of the cover elements. This is the position of at least one cover element because the potential danger of a missing or incorrectly assembled cover element may be different depending on the position thereof in the sequence of laid cover elements. For example, an incorrectly assembled first cover element that is arranged on the floor cover support adjacently to the comb plate conceals significant dangers for a user, since moving parts of the step belt or pallet belt are present under said first cover element and may immediately trap and cause life-threatening injuries to a person falling in. In contrast, cover elements that are arranged on the floor cover support further from the comb plate cover a less critical or dangerous region of the space provided under the floor, in which space, for example, the control cabinet and other electrical installations are arranged. Of course, at least one device may be provided for each cover element. The individual cover elements may comprise connection elements on the end faces thereof which, in the assembled state, face other cover elements. Said connection elements may be designed as a tongue and groove, for example.

A floor cover comprising a plurality of cover elements additionally has the advantage that only as many cover elements as necessary have to be removed if access to the space comprising the technical devices is to be provided by removing the at least one cover element.

In order to make the at least partial projection of an incorrectly assembled cover element yet easier to perceive, at least one side face of the cover element may be provided with a signal color. Instead of or in combination with the signal color, the side face may also comprise at least one reflective element. Of course, for the same purpose, at least one lamp may be provided on the side face, either alone, or in combination with a signal color and/or a reflective element. The lamp may be used constantly lit or also flashing. The lamp is preferably connected such that the power supply thereof is immediately interrupted as soon as the cover element is in its correct installation position. Alternatively, the lamp may be connected to the power source so as not to be lit or so as to flash when the cover element is in the incorrect installation position, and so as to be continuously lit when the cover element is arranged in the correct installation position on the floor cover support. In this case, it is advantageous for the light of the lamp to be able to reach the entry region in order to illuminate said region for the user and/or to indicate direction of revolution of the step belt or pallet belt.

When assembling the floor cover, the at least one cover element is laid on the floor cover support. The cover element is then brought into a specified correct installation position at least by means of pushing and/or inserting a fastening means. A visual check is then carried out to determine whether at least one part of the cover element is visibly projecting from the floor cover support. If this is the case, it is necessary to check whether the cover element is in the intended position thereof on the floor cover support and, if provided, whether the fastening means has been correctly assembled and if necessary sufficiently tightened.

Of course, the embodiments of the disclosure can be used not just in new escalators or moving walkways. For example, an existing floor cover can be replaced by a floor cover according to the disclosure, and an existing moving walkway can thus be modernized. Of course, it is also possible to supplement an existing floor cover with at least one device that is arranged at least in part between the floor cover support and the at least one cover element. As a result, one single possible correct installation position on the floor cover support is also specified for the existing cover element, the cover element, when assembled correctly, being arranged on the floor cover support so as to lie flush and/or so as to form, together with the floor cover support and the surrounding floor thereof, a smooth surface which can be walked on, and, when assembled incorrectly, at least one part of the cover element being arranged so as to visibly project beyond the floor cover support on account of the device.

BRIEF DESCRIPTION OF THE DRAWINGS

The floor cover comprising a device that specifies a single possible correct installation position of the existing cover element on the floor cover support will be described in more detail in the following, with reference to examples and in conjunction with the drawings, the same reference signs being used throughout for the same components in all the figures. In the drawings.

DETAILED DESCRIPTION

Figure 1:
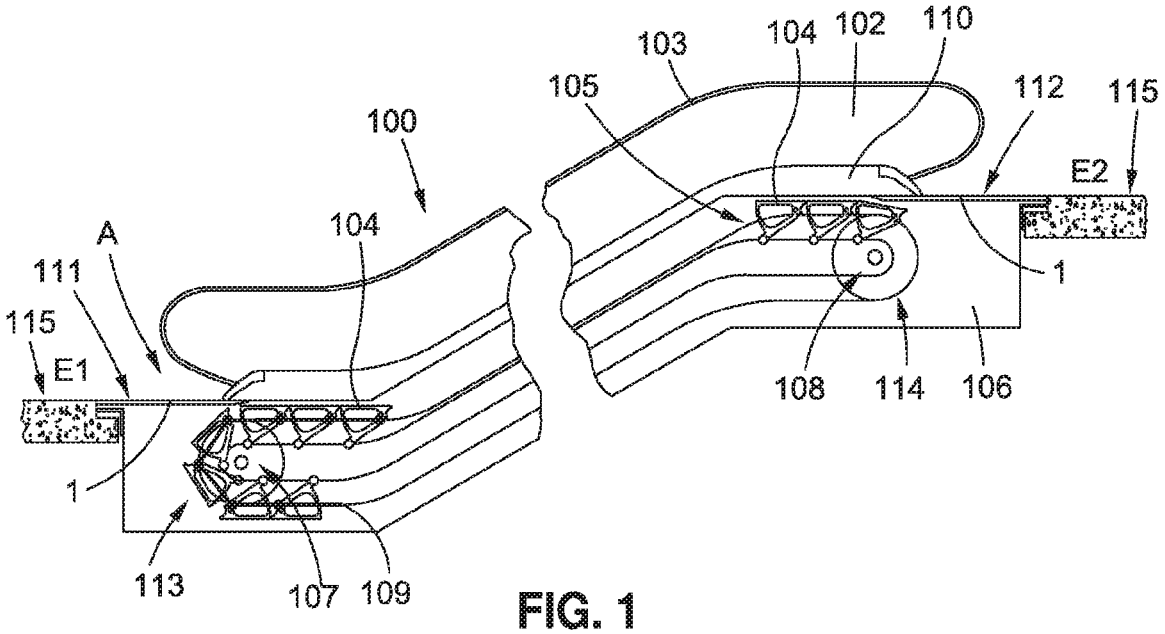
FIG. 1 is a schematic view of an escalator comprising a support structure or framework and two deflection regions, running rails being arranged in the framework, and a revolving step belt being arranged between the deflection regions.

FIG. 1 is a schematic side view of a passenger transportation device 100, which is designed as an escalator and which connects a first story E1 to a second story E2. The passenger transportation device 100 comprises a support structure 106 or framework 106 comprising two deflection regions 107, 108, between which a step belt 105 (shown only in part) is guided so as to revolve. The step belt comprises traction means 109 on which steps 104 are arranged. A handrail 103 is arranged on a balustrade 102. The balustrade 102 is connected to the support structure 106 at the lower end by means of a balustrade base 110. The passenger transportation device 100 or the step belt 105 thereof can be entered via entry regions 111, 112 provided at both ends of the passenger transportation device 100. The surfaces of the entry region 111, 112 which can be walked on are floor covers 1 which each close, in a flush manner, the opening of a space 113, 114 of the passenger transportation device 100, provided under the floor, to the surrounding floor 115 which can be walked on of the stories E1, E2.

Of course, the passenger transportation device 100 may also be designed as a moving walkway, instead of a step belt, a pallet belt being arranged so as to revolve, and the center of said passenger transportation device not being inclined or being less inclined than an escalator.

Figure 2:
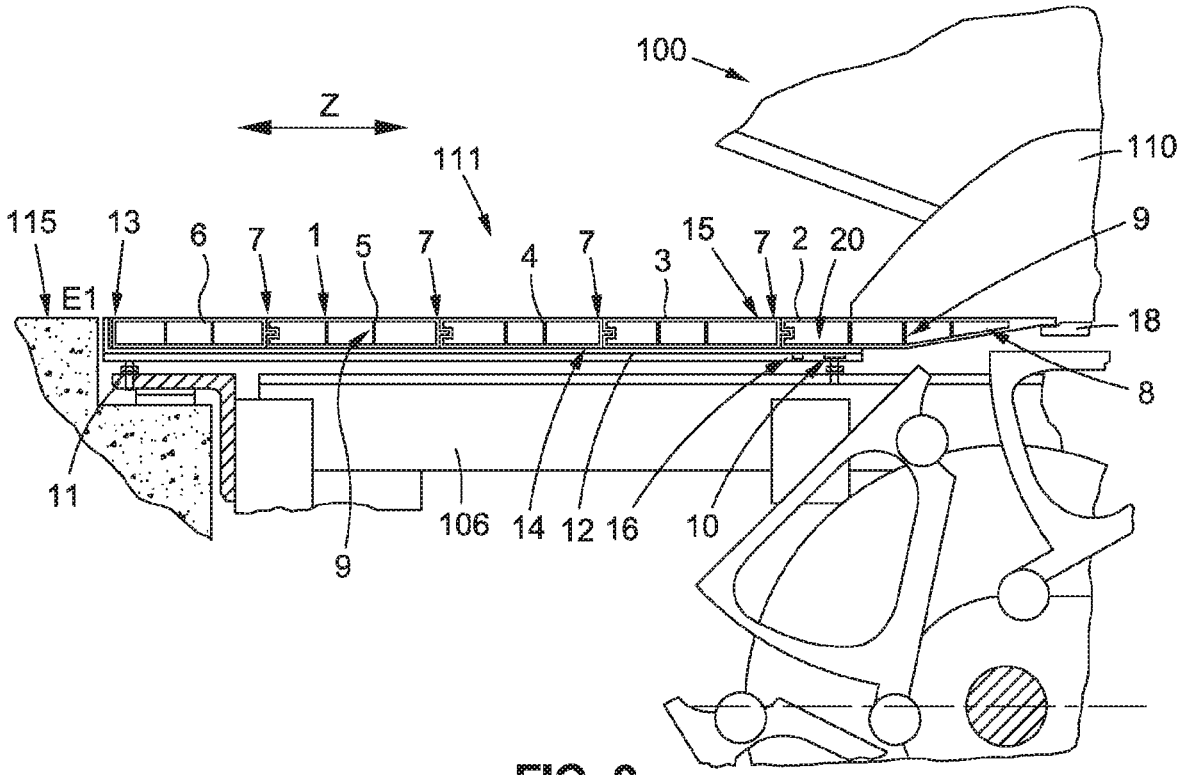
FIG. 2 is an enlarged view of the detail, denoted by A in FIG. 1, of an entry region, the details of the floor cover thus being more easily identifiable.

FIG. 2 is an enlarged view of the detail, denoted by "A" in FIG. 1, of an entry region 111 arranged in the story E1, the details of the floor cover 1 thus being more easily identifiable. The floor cover 1, shown in cross-section, comprises a plurality of cover elements 2, 3, 4, 5, 6. The first cover element 2, which is arranged on the right-hand side in FIG. 2, in the region of the balustrade base 110, is formed as a hollow profile having transverse connecting pieces 9 and the tapered right-hand side 8 thereof rests on a comb plate 18 that is part of a safety means. The left-hand side thereof ends in a separation point 7. The cover element 3 that is adjacent to the left-hand side is formed, in cross-section, as a rectangular hollow profile having transverse connecting pieces 9, and the further cover elements 4 to 6 are likewise designed so as to be of the same structure, in the form of hollow profiles having a rectangular cross-section and transverse connecting pieces 9. The end faces of the cover elements 2 to 6 may be interconnected at the separation points 7 by means of suitable connection elements 14, such as a tongue and groove. For example, the left-hand end faces of the cover elements 2 to 6 comprise a groove, and the right-hand end faces of the cover elements 3 to 6 comprise a tongue. A floor cover support 12 designed as an angular frame is fastened to the support structure 106 by means of adjustment screws 10, 11 such that the floor cover support 12 can be made level with the plane of the surrounding floor 115 which can be walked on of the story E1. The floor cover support 12 closes the floor cover 2 on two long sides (covered by the floor cover) which extend in the entry direction Z, and on one transverse side 13. All the cover elements 2 to 6 are shown in their correct installation position.

When assembling the floor cover 1, the assembly or servicing personnel must ensure in particular that the tapered side 8 of the first cover element 2 rests securely on the comb plate 18. In order to prevent slipping and tilting off, the first cover element 2 is rigidly connected, in the region of the left-hand end face 15 thereof, to the floor cover support 12 by a fastening means 16. The fastening means may be a screw connection 16 or other type of fastener, for example. Since said fastening means 16 is not visible when the floor cover 1 is completely assembled, it is also not possible to identify when, for example, the nut of the screw connection 16 is missing due to an assembly error.

In order to preclude this situation, according to the present disclosure, the floor cover 1 includes at least one device 20 by means of which one single possible correct installation position of the at least one cover element 2 to 6 on the floor cover support 12 is specified. In this case, the device 20 is arranged at least in part between the floor cover support 12 and the at least one cover element 2 to 6. Correct assembly is indicated by the cover element 2 to 6 being arranged so as to lie flush on the floor cover support 12. When incorrectly assembled, at least one part of the cover element 2 to 6 is arranged so as to visibly project beyond on the floor cover support 12 on account of the device 20.

The device 20 and the arrangement thereof in the floor cover 1 can be designed in various ways. Five possible embodiments will be described in the following. Other embodiments are also possible.

Figure 3:
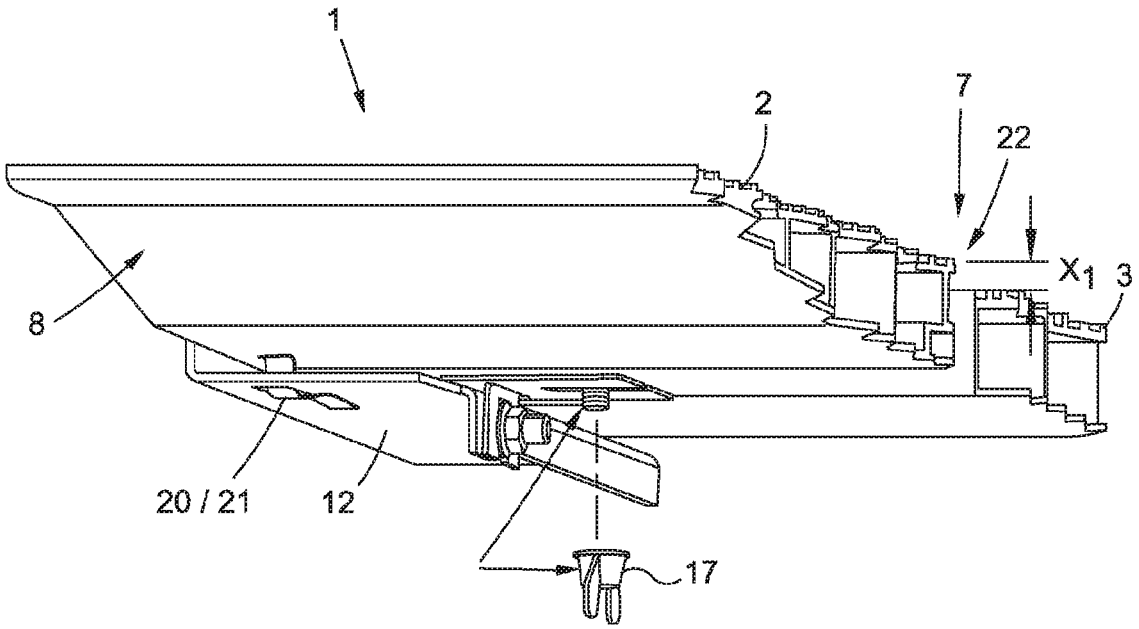
FIG. 3 is a three-dimensional view of a detail of a first embodiment of a floor cover, the floor cover comprising a device that comprises a spring element and a fastening means, and the cover element being shown in an incorrect installation position.
Figure 4:
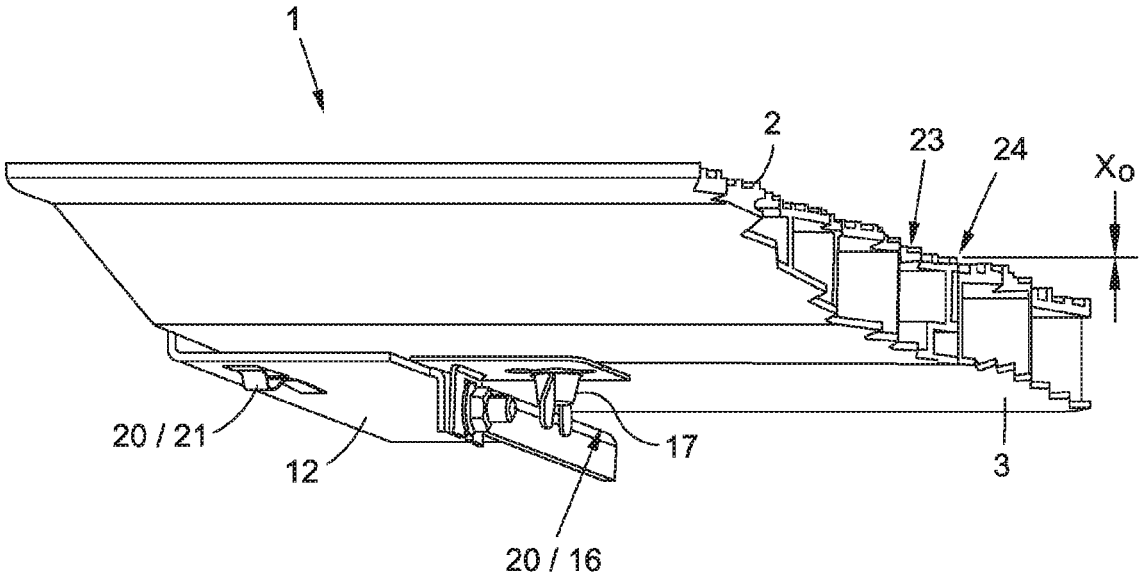
FIG. 4 is a three-dimensional view of the first embodiment in FIG. 3, the cover element being shown in the correct installation position.

FIGS. 3 and 4 are three-dimensional views of a detail of a first embodiment of a floor cover 1 comprising a device 20, as shown in FIG. 2. The part of the floor cover 1 denoted as the first cover element 2 in FIG. 2 is shown in the incorrect installation position $X_1$ in FIG. 3. As already described, a lack of or incorrect attachment of the fastening means 16 or screw connection 16 between the first cover element 2 and the floor cover support 12 is a serious danger. This incorrect attachment is shown in FIG. 3 by the removed wing nut 17. A screw connection 16 comprising a wing nut 17 is used if the floor cover 1 comprises a plurality of cover elements 2, as FIG. 2 shows. In order to indicate the incorrect installation position $X_1$, and thus the potential danger, the floor cover 1 comprises the device 20 that comprises the fastening means 16 and a resilient element 21. A spring element 21 that is arranged on the floor cover support 12 is used as the resilient element 21. In the region of the separation point 7, the spring tongue thereof holds the end face 15 of the cover element 2 in a position $X_1$ in which it is raised and thus visibly projecting relative to the adjacent floor of the story (not shown) and relative to the cover element 3 of the floor cover 1 that adjoins the end face.

The floor cover support 12 may be a frame manufactured from angle sections. Said angle sections may be manufactured from sheet steel cut out of a sheet metal plate in a stamping process and bent into angle sections. During stamping of the metal plate, the spring element 21 can also be shaped immediately. Of course, the spring element 21 may also be manufactured as a separate component and then fastened to the floor cover support 12. All types of springs, such as leaf springs, disc springs, screw compression springs, torsion springs, spiral springs, leg springs, and the like can be used as spring elements 21 provided that said springs are suitable for raising and holding the associated cover element 2 so as to visibly project beyond the floor cover support 12 when in the incorrect installation position $X_1$.

The cover element 2 is in the correct installation position $X_0$ only when the wing nut 17 of the fastening means 16 is assembled and fully tightened, as shown in FIG. 4. The upper surface 24 which can be walked on and which is provided with a ribbed tread 23 ends flush ($X_0$=0) with the surface which can be walked on of the cover element 3, which surface is arranged on the floor cover support 12 so as to be adjacent to the correctly assembled first cover element 2.

Figure 5:
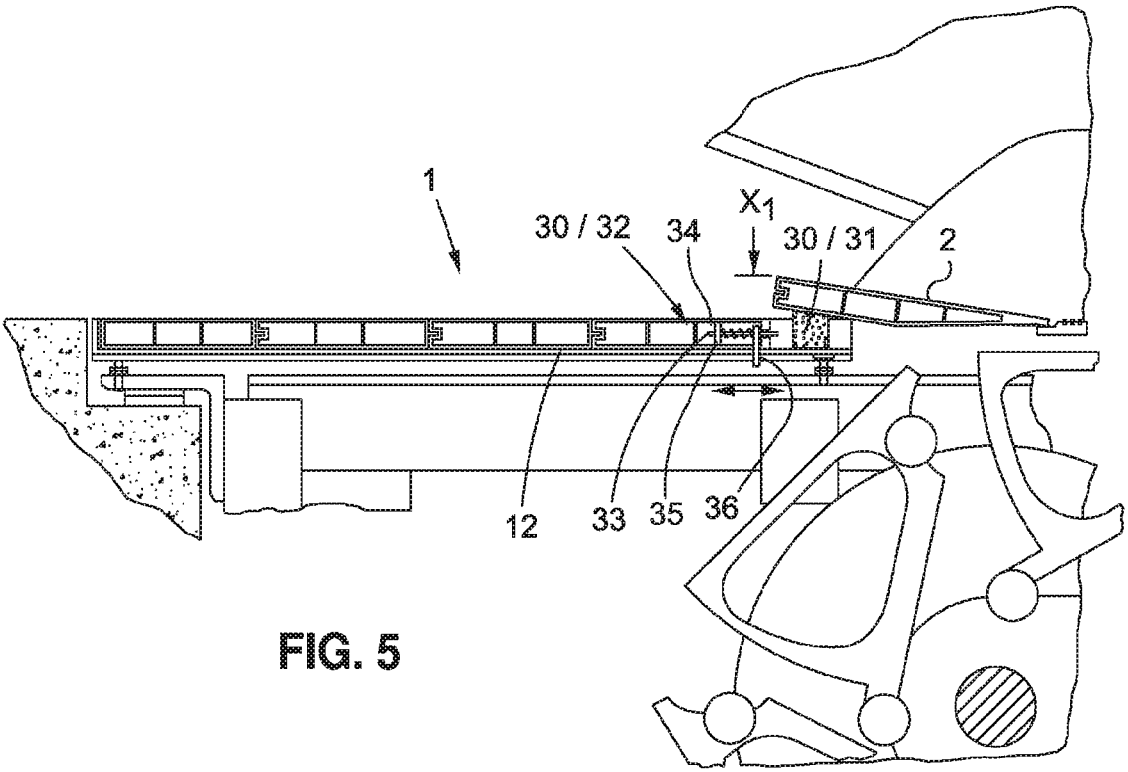
FIG. 5 is a cross-sectional side view of a second embodiment of a floor cover comprising a device having a block of resilient material and a fastening means, the cover element being shown in an incorrect installation position.

FIG. 5 is a cross-sectional side view of a second embodiment of a floor cover 1 which, similarly to the first embodiment, also comprises a device 30 comprising a resilient element 31 and a fastening means 32. The resilient element 31 is a block of resilient material 31 such as foam or plastic-like deformable material, for example, polyurethane foam. Said foam can be fastened to the floor cover support 12 by adhesive bonding or by mechanical fastening means and can retain its elasticity for decades, even when compressed. The size of the element reduces under pressure, and when unloaded the resilient element 31 returns to its original shape. A locking means 32 that is fastened to the floor cover support 12 and comprises a bolt 33, a compression spring 34, and guides 35, 36 is used as the fastening means 32. In FIG. 5, the bolt 33 is shown in the release position, such that the locking means 32 releases the first cover element 2 and the resilient element 31 is relaxed and in its original shape. It is accordingly indicated unmistakably to everyone that, as shown, the cover element 2 is in an incorrect installation position $X_1$.

Instead of the linearly displaceable bolt 33 shown, a rotary bolt mounted in the cover element 2 may also be used, the axis of rotation of which rotary bolt is arranged so as to be vertical to the planar extension of the cover element 2. Said rotary bolt can be actuated from the surface which can be walked on of the cover element 2 using a specialized wrench, for example.

Alternatively, or in addition to the locking means 32, it is of course also possible to use the screw connection 16 of the first embodiment in this embodiment comprising a block of resilient material 31, too. These variants can be easily retrofitted to all existing passenger transportation devices 100 and can thus significantly improve the safety of existing escalators or moving walkways.

Figure 6:
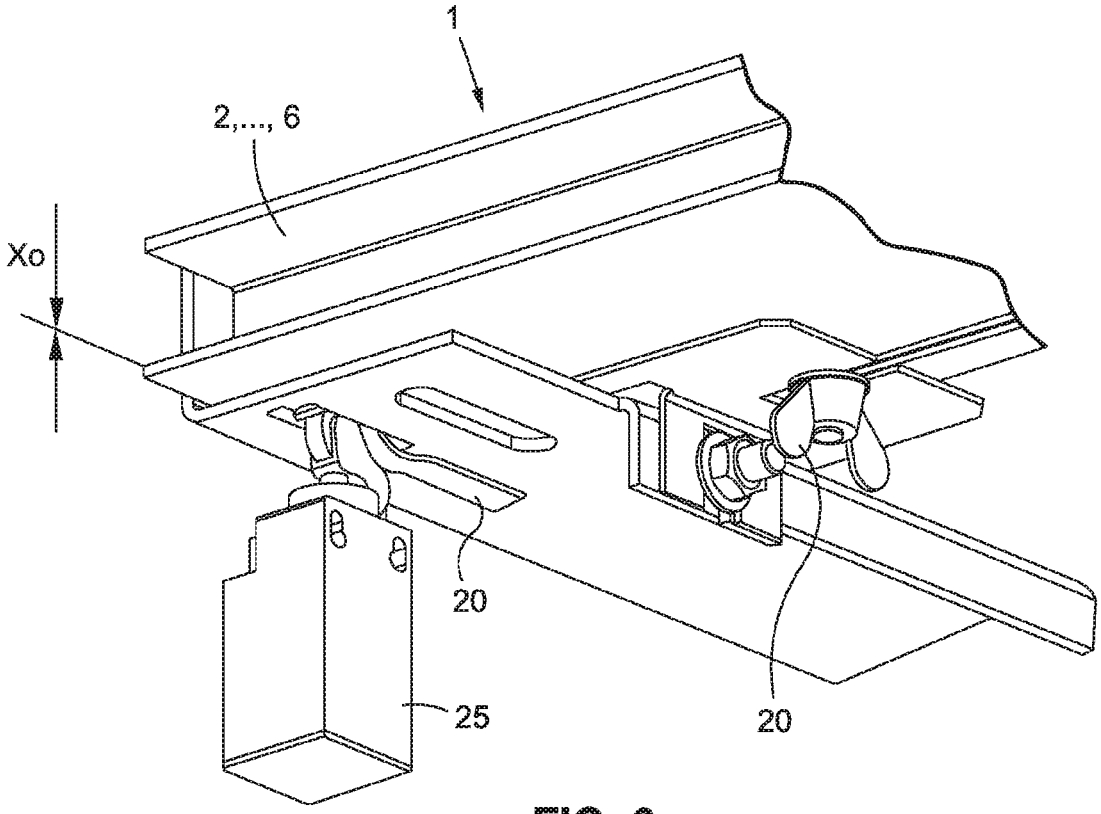
FIG. 6 is a three-dimensional view of the first embodiment in FIG. 3, the correct installation position of the cover element being monitored by a sensor or switch.

It is particularly advantageous for an incorrectly assembled cover element 2 to 6 of the floor cover 1 to directly influence the operating state of the passenger transportation device 100. In order to achieve this, as shown in FIG. 6, the correct installation position $X_0$ of the cover element 2 to 6 can be monitored by a sensor 25 or switch 25. FIG. 6 is a three-dimensional view of a possible manner of attaching the sensor 25 or switch 25, on the basis of the first embodiment of the floor cover 1 comprising the device 20 shown in FIGS. 3 and 4. A simple switch 25 can be used for this purpose, which directly interrupts the supply of power to a drive motor of the step belt 105 or pallet belt, for example.

Alternatively, the switch 25 or sensor 25 can transmit a signal to a control means of the passenger transportation device 100 that corresponds to the installation position of the cover element 2 to 6, such that, in the incorrect installation position $X_1$ (see FIGS. 3 and 5), the control means immediately causes the step belt 105 or pallet belt to come to a standstill or maintains said standstill, and, in the correct installation position $X_0$, enables the operation with respect to the floor cover 1.

Figure 7:
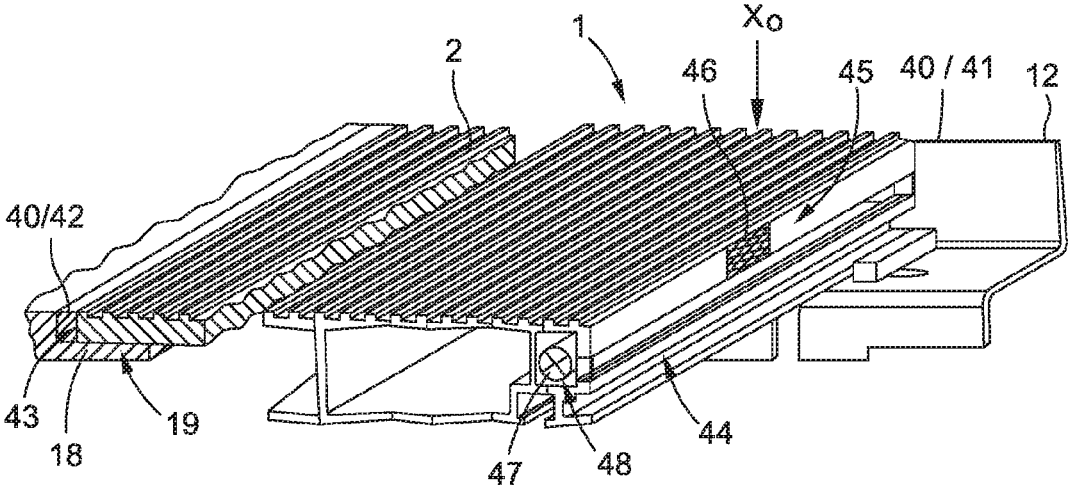
FIG. 7 is a three-dimensional view of a detail of a third embodiment of a floor cover, the floor cover comprising a device that comprises a stop piece and a resilient element, and the cover element being shown in the correct installation position.

FIG. 7 is a three-dimensional view of a detail of a third embodiment of a floor cover 1. Said floor cover 1 comprises the device 40 that comprises a stop piece 41 and a resilient element 42. The cover element 2 is shown in the correct installation position $X_0$. The stop piece 41 is an incompressible solid body, for example, a steel strip, which is rigidly connected to the floor cover support 12. The distance thereof from the comb plate 18 corresponds to the width of the first cover element 2. The comb plate 18 comprises a support region 19 that is designed such that the tapered side 8 of the first cover element 2 can be laid flush against the comb plate 18.

The strip-like resilient element 42, shown in the compressed state, is arranged between the side face 43 of the first cover element 2 facing the comb plate 18 and the comb plate 18. When not compressed, the resilient element 42 protrudes so far that the side face 44 of the first cover element 2 on the opposite side rest on the stop piece 41 and is thus arranged so as to visibly project beyond the floor cover support 12. In order to correctly assemble the first cover element 2, said element must be pressed against the comb plate 18 when being laid on the floor cover support 12, such that the resilient element 42 is compressed until the opposite side face 44 can be laid beyond the stop piece 41 and said side of the first cover element 2 can be laid on the floor cover support 12.

Of course, the cover element 3 (not shown) that is to be laid on subsequently has to comprise a notch that corresponds to the stop piece 41 in order for said element not to lie on the stop piece 41 and thus be arranged so as to visibly project beyond the floor cover support 12. The stop piece prevents the first cover element 2 from slipping off and tilting away from the comb plate 18 and thus from the support region 19 of the comb plate 18.

In order that the at least partial projection of an incorrectly assembled cover element 2 to 6 can be perceived yet more easily, it is possible, as shown with reference to the first cover element 2, for at least one side face 44 of the cover element 2 to be provided with a signal color 45 such as neon yellow, neon orange, and the like.

Instead of or in combination with the signal color 45, the side face 44 may also comprise at least one reflective element 46. Of course, for the same purpose, at least one lamp 47 may also be provided on the side face 44, as shown schematically by the luminous element 47 arranged in a groove 48. The lamp 47 may be used alone or in combination with a signal color 45 and/or a reflective element 46.

Figure 8:
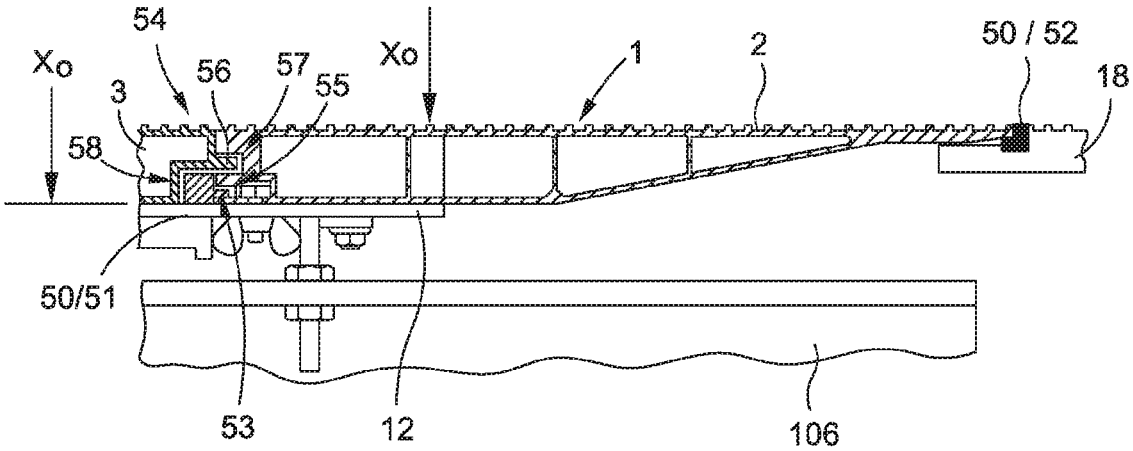
FIG. 8 is a cross-sectional side view of a fourth embodiment of a floor cover comprising a device having a stop piece and a resilient element, the cover element being shown in the correct installation position.

FIG. 8 is a cross-sectional side view of a fourth embodiment of a floor cover 1, differing only slightly from the third embodiment shown in FIG. 7. Said floor cover also comprises a device 50 comprising a stop piece 51 and a resilient element 52, the first cover element 2 likewise being shown in the correct installation position $X_0$. The difference is that the stop piece 51 additionally comprises a nose 53 that extends in parallel with the floor cover support 12, in the direction of the comb plate 18. A cap groove 55 is formed on the side face 54 of the first cover element 2 that is remote from the comb plate 18 in the assembled state, in which groove the nose 53 engages in the correct installation position $X_0$, as shown.

FIG. 8 also shows how the further cover element 3 that adjoins the first cover element 2 is positively interconnected by means of the connection element formed as a tongue 56 and groove 57. The notch 58 provided on the further cover element 3 can also be seen, which notch allows said cover element to lie in a flush manner on the floor cover support 12.

Figure 9:
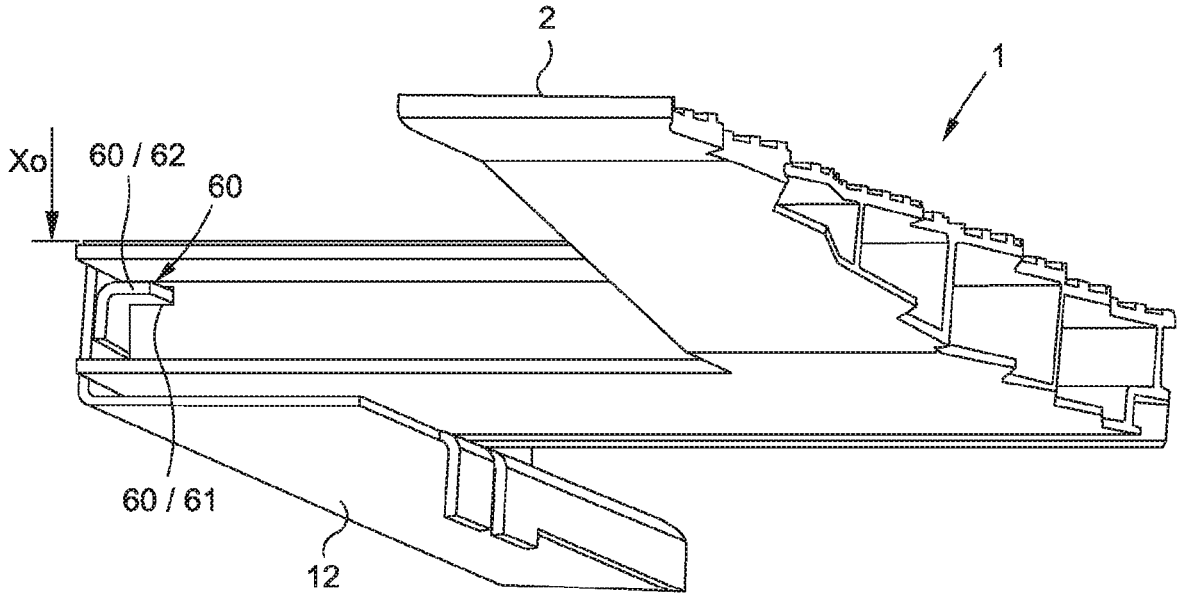
FIG. 9 is a three-dimensional view of a detail of a fifth embodiment of a floor cover, the floor cover comprising a device that comprises a recess on the cover element and a projection on the floor cover support that corresponds to said recess, and the cover element being shown in the correct installation position.
Figure 10:
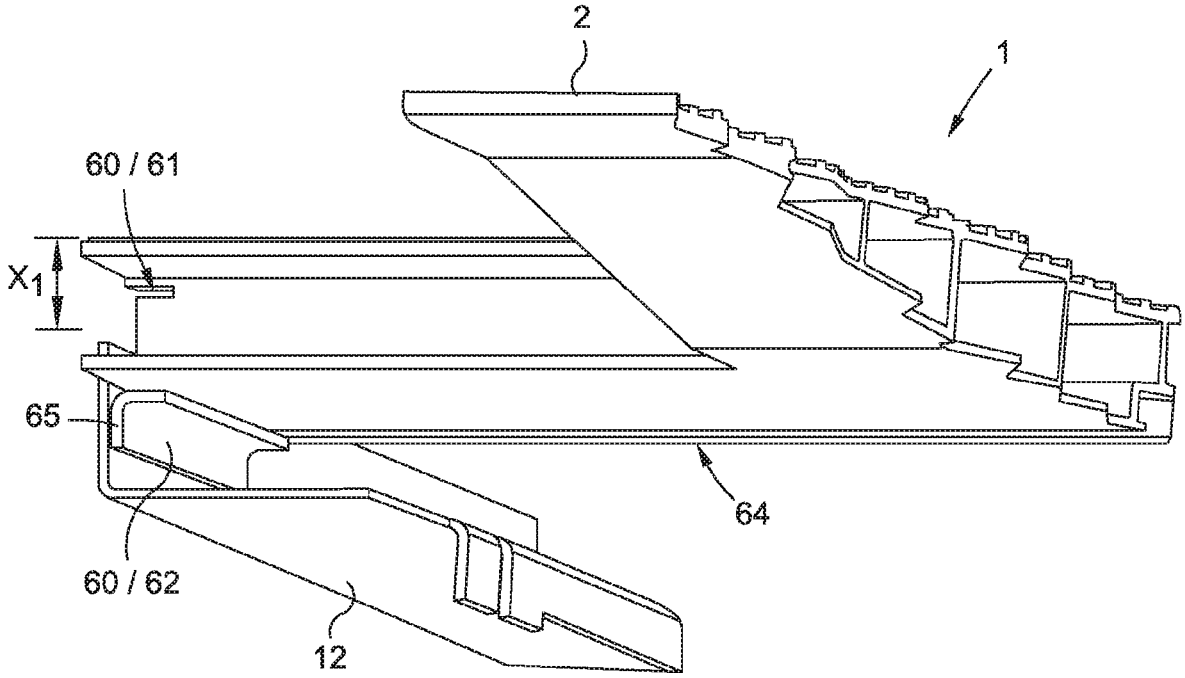
FIG. 10 is a three-dimensional view of the fifth embodiment in FIG. 9, the cover element being shown in the incorrect installation position.

FIGS. 9 and FIG. 10 are three-dimensional views of a detail of a fifth embodiment of a floor cover 1. The cover element 2 is shown in the correct installation position $X_0$ in FIG. 9, and the first cover element 2 is shown in the incorrect installation position $X_1$ in FIG. 10. The floor cover 1 comprises a device 60 that comprises a recess 61 on the cover element 2 and a projection 62 on the floor cover support 12 that corresponds to said recess 61.

As shown, the device 60 may comprise at least one projection 62 on the floor cover support 12 and a recess 61 on the cover element 2 that corresponds to said projection 62. Of course, the at least one recess 61 may also be formed on the floor cover support 12, and a projection corresponding to said recess 61 may be formed on the cover element 2. In the correct installation position $X_0$, the projection 62 protrudes into the recess 61, as shown in FIG. 9. In the incorrect installation position $X_1$, the at least one cover element 2 is either arranged on the projection 62 so as to project above and protrude beyond the floor cover 12, as shown in FIG. 10, or the cover element 2 protrudes beyond the comb plate (not shown) so as to visibly project or so as to overlap by means of a front face 65 of the projection 62 protruding onto the rear edge 64 of the cover element 2.

In order to forcibly bring about the single correct installation position $X_0$ of the cover element 2, the projection 62 and the recess 61 extend in a plane in parallel with the planar extension of the cover element 2 or in parallel with the floor cover support 12, such that any tilting moments of the cover element 2 arranged on the floor cover support 12 can be absorbed or supported by the device 60 alone on account of the engagement of the projection 62 in the recess 61. In order to bring the cover element 2 into the correct installation position $X_0$, it is not sufficient to simply lay said element on the floor cover support 12. When laid on the floor cover support 12, the cover element 2 still has to be shifted in the direction of the extension of the projection 62 until it has reached the correct installation position $X_0$. If said cover element is only laid on but not shifted, it does not fit into the floor cover support 12 and one side of said element projects therefrom. In some circumstances, the cover element 2 has to be formed in multiple parts or comprise at least one articulation point in order that the projection 62 can be inserted into the recess 61.

Preferably, the projection 62 is a strip and the notch 61 is a groove. The strip can be created for example in that, as shown in FIGS. 9 and 10, an angle section is arranged on a lateral portion of the floor cover support 12. A groove that corresponds to the strip is then formed on the cover element 2.

Although the disclosure has been described through the illustration of specific embodiments, it is clear that numerous additional variants can be created within the context of the present disclosure, for example in that a sensor 25 or switch 25 is used to monitor the correct assembly of the first cover element 2 in each of the embodiments. Furthermore, the first cover element 2 may also comprise a plurality of devices 20, 30, 40, 50, 60. All the embodiments can also be applied in the case of floor covers 1 that comprise a plurality of cover elements 2 to 6. In the case of floor covers 1 of this kind, at least one device 20, 30, 40, 50, 60 may be provided for each of the cover elements 2 to 6. Moreover, it is in principle irrelevant as to which part of the fastening element 16 or the locking means 32 is arranged on the cover element 2 to 6 or on the floor cover support 12. For example, the locking means 32 may be arranged on the cover element 2 to 6, and the hole in which the bolt 33 is to engage may be made on the floor cover support 12. Of course, the locking means 32 may also be arranged on the floor cover support 12, and the hole in which the bolt 33 is to engage may be made on the cover elements 2 to 6.

Of course, existing passenger-transporting systems 100 can also be modernized in that the existing floor covers 1 thereof are replaced by floor covers 1 according to the disclosure, or the existing floor covers 1 are supplemented with corresponding devices 20, 30, 40, 50, 60.

The invention claimed is:

1. A floor cover of an entry region of a passenger transportation device that is formed as an escalator or a moving walkway, the floor cover comprising:

a floor cover support and at least one cover element, wherein an opening of a space provided under a floor of the passenger transportation device can be closed in a flush manner to a surrounding floor which can be walked on by the at least one cover element that is laid on the floor cover support, at least one device that is arranged at least in part between the floor cover support and the at least one cover element, the at least one device transitionable between a first configuration and a second configuration, wherein:

in the first configuration, the at least one cover element lies flush on the floor cover support, in the second configuration, the at least one device is configured to cause at least one part of the at least one cover element to visibly project beyond the floor cover support, and the at least one device is biased towards the second configuration, and a fastener configured to connect the at least one cover element to the floor cover support such that, when fastened, the fastener causes the at least one device to be in the first configuration and secures the at least one cover element flushly to the floor cover support.

2. The floor cover of claim 1, wherein the at least one device comprises at least one resilient element.

3. The floor cover of claim 2, wherein the resilient element is a block of resilient material or a spring element and the fastener comprises a screw connection.

4. The floor cover of claim 1, wherein the device comprises at least one projection on the cover element and a recess on the floor cover support that corresponds to the projection, wherein, in the correct installation position, the projection protrudes into the recess, and in the incorrect installation position the at least one cover element is arranged against the projection so that the cover element is visibly projecting.

5. The floor cover of claim 4, wherein the projection and the recess extend in parallel with the planar extension of the cover element or in parallel with the floor cover support.

6. The floor cover of claim 5, wherein the projection comprises a strip and the recess comprises a groove.

7. The floor cover of claim 1, wherein the device comprises at least one stop piece on the cover element and a notch on the floor cover support that corresponds to the stop piece, wherein, in the correct installation position, the stop piece protrudes into the notch, and in the incorrect installation position the at least one cover element is arranged against the stop piece so that the cover element is visibly projecting.

8. The floor cover of claim 7, wherein a nose, extending in parallel with the floor cover support, is arranged on the stop piece, and a cap groove that corresponds to the nose is arranged on the cover element, wherein, in the correct installation position of the cover element, the nose engages in the cap groove.

9. The floor cover of claim 7, wherein the device comprises at least one resilient element that is arranged in a region of an end face of the cover element which is remote from the stop piece or the notch or the cap groove.

10. The floor cover of claim 1, wherein the device comprises at least one sensor or switch configured to monitor a correct installation position or any other installation positions of the cover element.

11. The floor cover of claim 1, wherein the cover comprises a plurality of cover elements that are laid on the floor cover support so as to be adjacent to one another, and at least one device is associated with at least one of the cover elements.

12. The floor cover claim 1, wherein access to the space arranged under the floor can be provided by removing the at least one cover element.

13. The floor cover of claim 1, wherein at least one side face of the cover element is provided with at least one of a signal color, a reflective element, and a lamp.

14. A method for correctly assembling the at least one cover element of the floor cover of claim 1, comprising:

during assembly, laying the at least one cover element on the floor cover support such that the at least one device being is arranged at least in part between the floor cover support and the at least one cover element;

bringing the cover element into an intended correct installation position at least by pushing and/or inserting a fastener; and performing a visual check to determine whether one part of the cover element is visibly projecting from the floor cover support.

15. A method for modernizing a passenger transportation device formed as an escalator or moving walkway, wherein an existing floor cover is supplemented, in at least one of the entry regions of the existing moving walkway or of the existing escalator, with at least one device, which device is arranged at least in part between the floor cover support and the at least one cover element, such that the floor cover of claim 1 is created by this supplementation.

16. The floor cover of claim 1, wherein the at least one device further comprises:

at least one recess on the cover element, and a projection on the floor cover support that corresponds to the recess, wherein, in a correct installation position, the projection protrudes into the recess, and in any other installation positions the at least one cover element is arranged against the projection so that the cover element is visibly projecting.

17. The floor cover of claim 1, wherein the at least one device comprises:

at least one stop piece on the floor cover support, and a notch on the cover element that corresponds to the stop piece, wherein, in an correct installation position, the stop piece protrudes into the notch, and in any other installation positions the at least one cover element is arranged against the stop piece so that the cover element is visibly projecting.

18. The floor cover of claim 2, wherein the resilient element is a block of resilient material or a spring element and the fastener comprises a locking means.

* * * * *